US006095709A

United States Patent [19]

Armer et al.

[11] Patent Number: 6,095,709

[45] Date of Patent: Aug. 1, 2000

[54] LIQUID SOAP DISPENSER AND SCRUB BRUSH

[76] Inventors: Mark Armer, 9201 Independence Ave.; Frederick George Eiler, 10019 Mason Ave., both of Chatsworth, Calif. 91311

[21] Appl. No.: 09/324,404

[22] Filed: Jun. 2, 1999

Related U.S. Application Data

[60] Provisional application No. 60/089,705, Jun. 18, 1998.

[51] Int. Cl.[7] ..... A46B 11/00

[52] U.S. Cl. ..... 401/268; 401/118; 401/131; 401/123

[58] Field of Search ..... 401/270, 131, 401/118, 121, 122, 123, 136, 188 R, 268; 15/104.94, 160, 159.1, 167.3, DIG. 6; 248/688, 693, 110, 111, 112, 113

[56] References Cited

U.S. PATENT DOCUMENTS 2,774,093 10/1956 King ..... 401/122
5,945,076 8/1999 Leonard et al. ..... 422/300

*Primary Examiner*—Steven O. Douglas
*Assistant Examiner*—Huyen Le
*Attorney, Agent, or Firm*—Ladas & Parry

[57] ABSTRACT

A combination liquid soap dispenser and scrub brush for dispensing a liquid onto a scrub brush or other cleaning implement. The combination liquid soap dispenser and scrub brush includes a container for holding a liquid, a carrier for holding the cleaning implement, and a means to mount the carrier in suspension above the liquid in the container. In use, the carrier with cleaning element is depressed through downward force to the level of the liquid in the container so as to coat the cleaning implement evenly.

7 Claims, 6 Drawing Sheets

8
9
10
16
16
27
29
31
32

LIQUID SOAP DISPENSER AND SCRUB BRUSH

This Application claims the benefit of U.S. Provisional Application No. 60/089,705, filed Jun. 18, 1998.

BACKGROUND OF THE INVENTION

The present invention relates to a combination liquid soap dispenser and scrub brush, and in particular a liquid soap dispenser which has a carrier mechanism which delivers a hand/nail scrub brush into a bath of soap or other suitable cleaning agent. This carrier also acts as a suspension device which allows—for drip drying of the hand/nail scrub brush.

Hand/nail scrub brushes are commonly used items in our society, and are generally used for hygienic purposes. The scrub brushes are generally kept on a counter top, in a dish, or hung on some type of hook. In some cases the scrub brushes are quite unsightly.

To use liquid soap with a hand/nail scrub brush, the user generally deposits the liquid soap either on his/her hands or on the scrub brushes bristles directly. In both cases, the liquid soap is not evenly distributed across the outer ends of the scrub brush bristles. This negatively affects the efficiency of the disinfecting and cleaning ability of the scrub brush, and can also unnecessarily waste liquid soap.

Once used, the scrub brushes are generally returned to their original positions. In the case of the first two locations, the bristles of the brush are usually placed in contact with a surface; this orientation often results in the development of a puddle of water around the brush bristles. The puddle often does not allow the brush to dry completely. In fact, the puddle itself can also facilitate the growth of bacteria.

Although many different liquid soap dispensers and scrub brushes are available, none of the liquid soap dispensers currently provide a housing for a scrub brush;, as well as a mechanism that acts as both a suspension device for drip-drying and a delivery system for the brush to evenly distribute a coat of the liquid soap to the outer ends of the scrub brush bristles.

SUMMARY OF THE INVENTION

The broad purpose of an embodiment of the present invention is to provide the means for the aesthetic housing of a hand/nail scrub brush, the means for drip-drying the scrub brush, and the means for easily applying liquid soap to the hands and the hand/nail scrub brushes bristles evenly. In one embodiment of the present invention, the liquid soap dispenser has a standard pump on one side and an opening at the top. A carrier mechanism resides inside the liquid soap dispenser's hallow construction. The carrier is suspended or supported by springs. The scrub brush resides on the carrier's support pads. The brushes bristle configuration minimizes contact between itself and the carrier. The carrier is guided in its movement, has grating on the main flat surface, and a perimeter wall completely outside the opening in the top of the housing.

In an additional embodiment of the present invention, the carrier may be broken into two separate components. The grating portion in the center of the carrier could be independent of the carrier support pads and walls. In this configuration the grating might use Archimedes Principle to float on the surface of the liquid soap or other suitable cleaning agent. The grating might also be guided in its movement. One guiding feature might be similar to the offset walls that guide the hand/nail scrub brush into the liquid soap, or a guiding feature similar to the guide bars that guide the carrier in its motion.

To use the described scrub brush, one need only press on the handle of the scrub brush. This action will cause the carrier to submerge into the liquid soap allowing the bristles to contact the aforementioned liquid soap. The standard pump is available for applying soap for hand washing. The preferred embodiment of the invention is to allow the user the facilities to house a scrub brush in an aesthetically pleasing fashion, the means to easily and evenly apply soap to the scrub brush, and the means for drip-drying the scrub brush. These all allow for greater ease of use, more convenience, potential cost savings in liquid soap, and can be manufactured and assembled at a relatively low cost.

Still further objects and advantages of the present invention will become readily apparent to those skilled in the art to which the invention pertains upon reference to the following detailed descriptions.

DESCRIPTION OF THE DRAWING

The description refers to the accompanying drawings in which like reference characters refer to like parts throughout the several views and in which.

DESCRIPTION OF A PREFERRED EMBODIMENT

Figure 1:
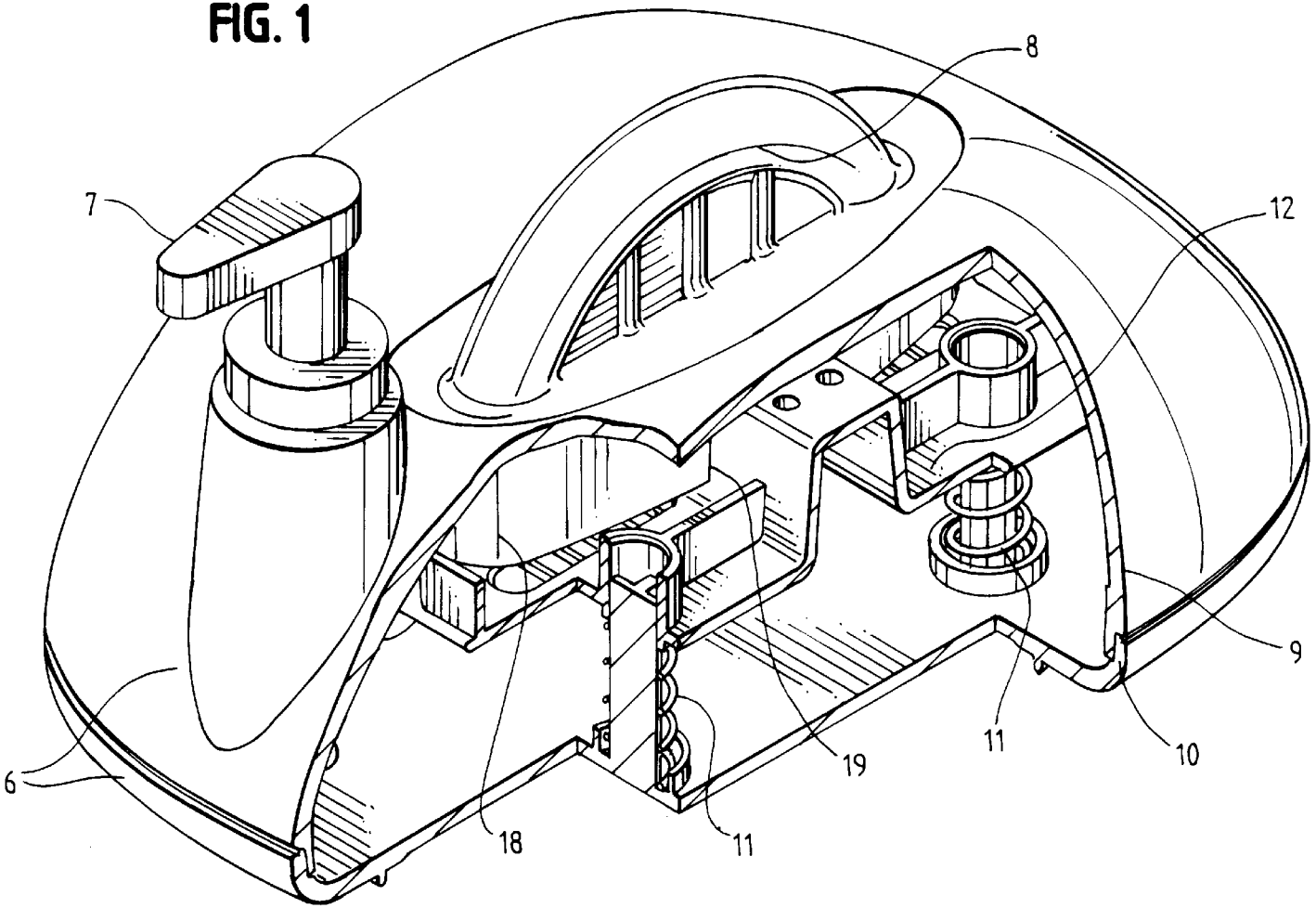
FIG. 1 is a perspective view of a combination modified liquid soap dispenser, pump, and hand/nail scrub brush assembly illustrating the preferred embodiment of the invention.
Figure 2:
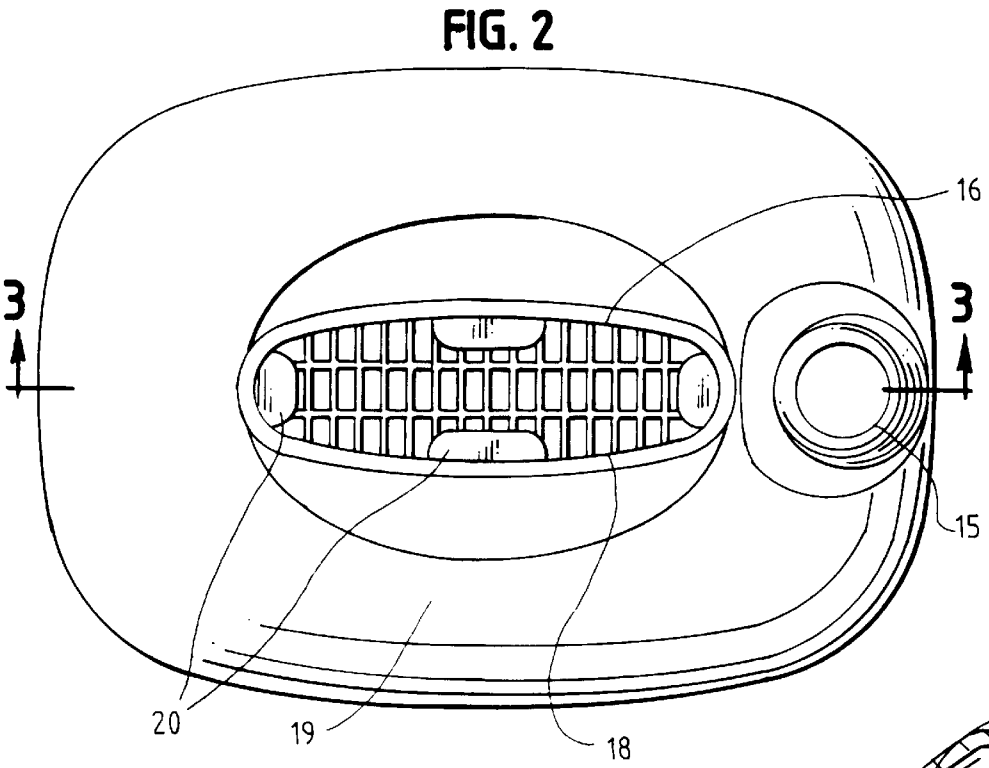
FIG. 2 is a top view or plan view of the assembly FIG. 1, scrub brush and pump removed.
Figure 3:
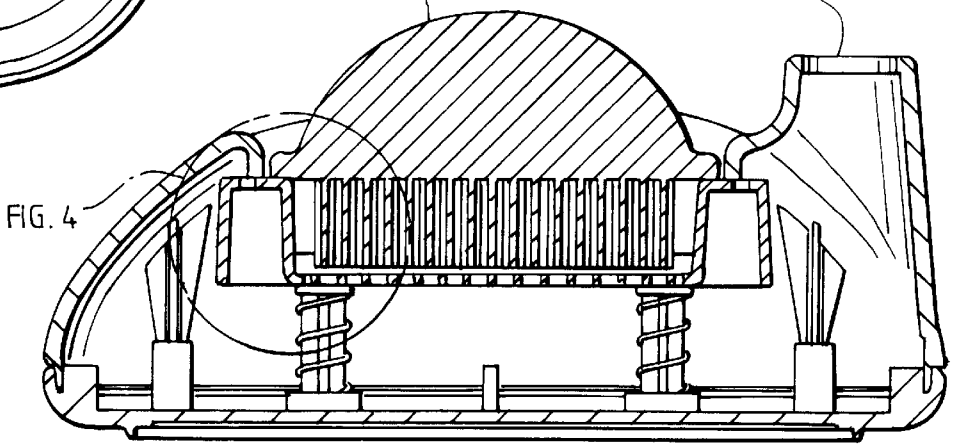
FIG. 3 is a projected sectional view taken through A—A, pump removed, of FIG. 2.
Figure 4:
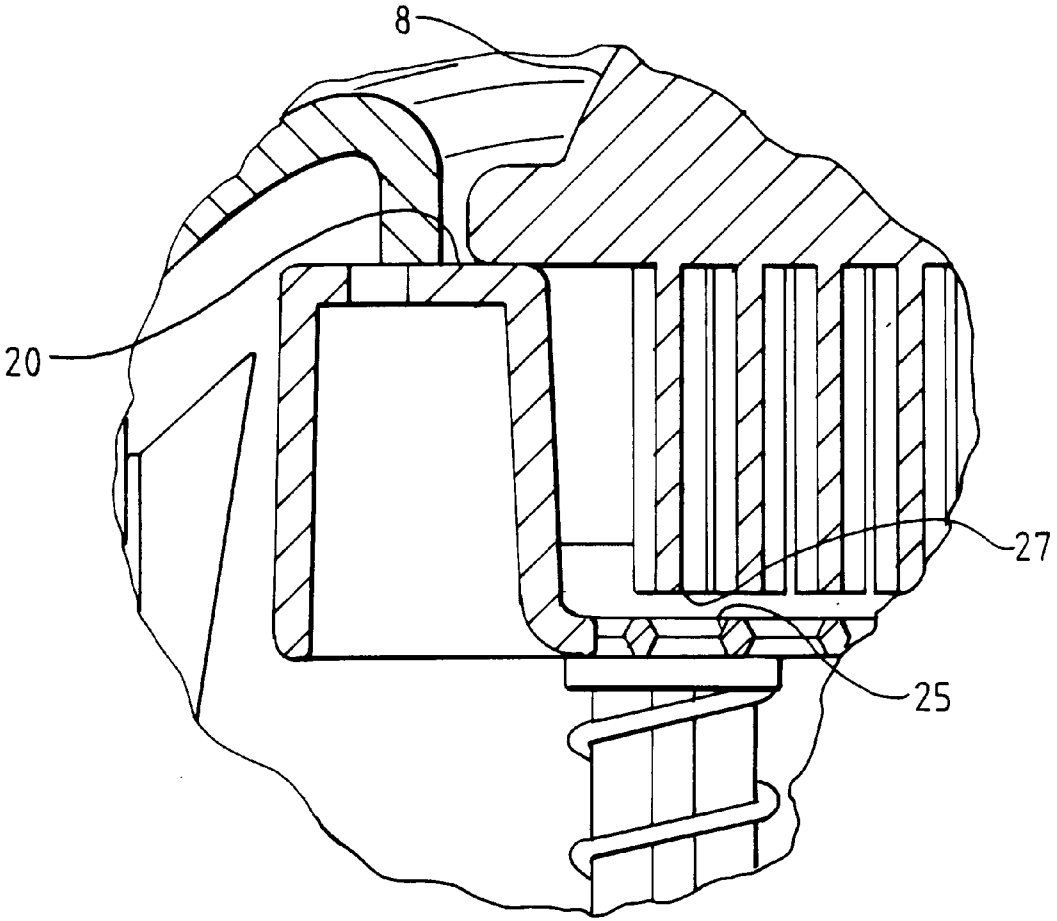
FIG. 4 is a detailed view of FIG. 3, taken interior to circle DETAIL B.
Figure 5:
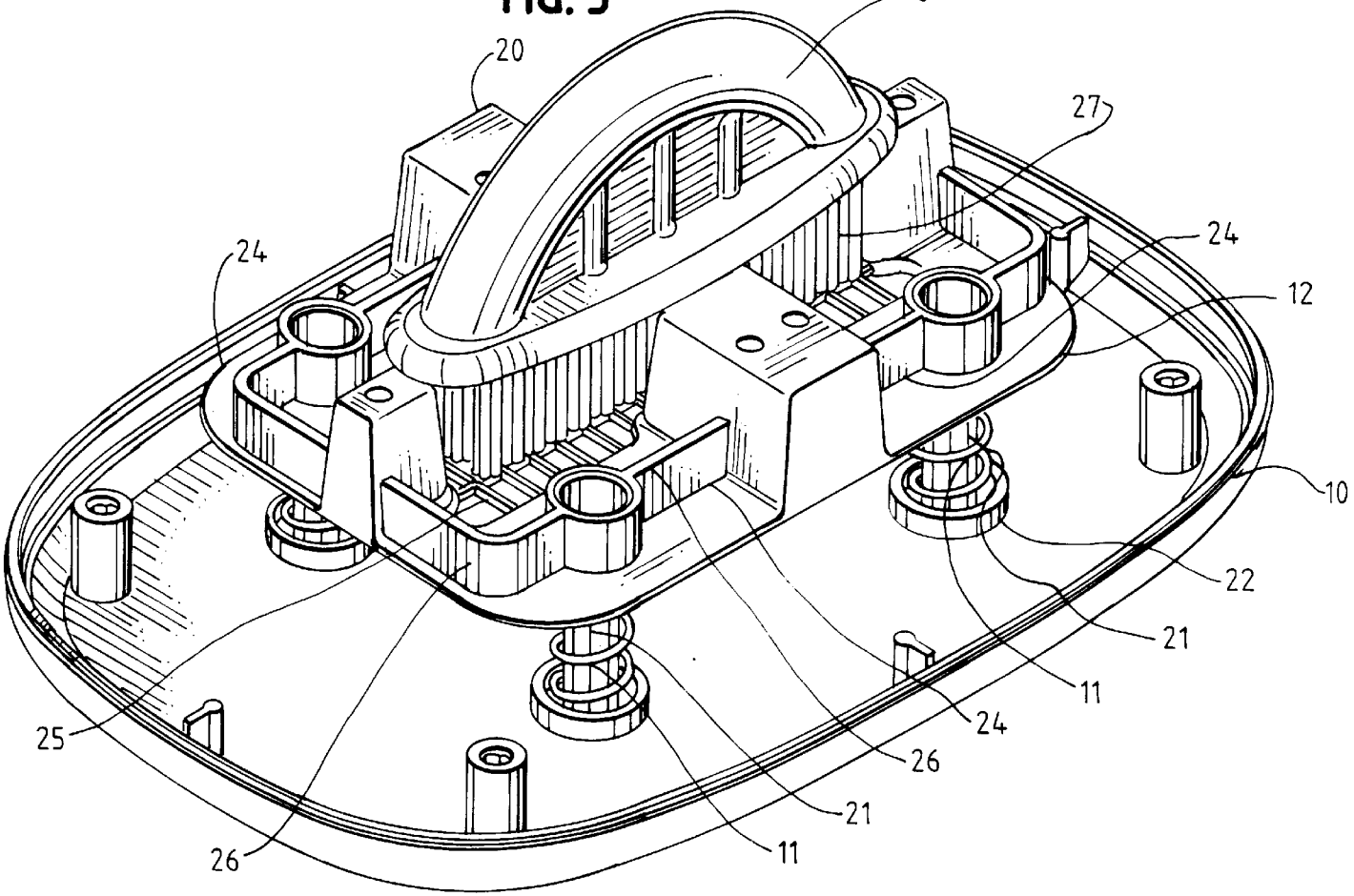
FIG. 5 is a perspective view of the assembly with top housing and pump removed.

Referring to the drawings, FIG. 1 illustrates an embodiment of a combination of a modified liquid soap dispenser 6, pump assembly 7, and hand/nail scrub brush 8.

The modified liquid soap dispenser 6 is made up of five parts comprising an upper housing 9, a lower housing 10, springs 11, a carrier 12, and a pump assembly 7. The upper 9 and lower 10 housings are bonded or welded together to produce the reservoir for the liquid soap.

Referring to FIGS. 2–5, the upper housing 9 has a hole 15 for the pump assembly 7, and a cutout 16 for the hand/nail scrub brush 8. The cutout 16 is an offset of the outside shape of the hand/nail scrub brush 8; this provides a locating feature for the hand/nail scrub brush 8. The sidewalls 18 of the cutout 16 have clearance slots 19 for the carriers 12 support pads 20.

The lower housing 10 has guide bars 21 that locate the carrier 12. Surrounding these guide bars 21 are cylindrical walls 22, which locate the springs 23. These springs 23 support the carrier 12, and provide the necessary return force for the carrier 12 during the liquid soap application to the hand/nail scrub brush 8.

The carrier's 12 shape consists mainly of a flat plate 24. The center of the flat plate 24 has a grated area 25. The grated area 25 allows for the flow of liquid soap through the carrier. The grated area 25 is surrounded by a retaining wall 26. There are four support pads 20, one at the center of each retaining wall 26. These support pads 20 rise far enough above the grated area 25 to keep the scrub brush bristles 27 from contacting any of the grated area 25 surfaces. The support pads 20 allow the scrub brush 8 to drip-dry effectively. The support pads 20 are also the means used to allow the user to press on the handle of the soap brush to apply the liquid soap evenly across the outer ends of the scrub brush bristles 27.

In operation a user simply pushes down on the brush 8 which is resting upon the carrier pad 20. Pushing down against the force of coil springs 11 will allow the brush and carrier to be lowered into the dispenser so that the bottom of the bristles will be in contact with the liquid soap contained within the reservoir defined by upper and lower housings 9 and 10. By releasing pressure the springs will elevate the brush for the operator to remove. After use, the brush is rinsed off and replaced on the carrier support pad, with the lower bristles 27 extending above the grated area of the carrier 12 so that the brush 8 is suspended for drip drying of the bristles 27.

Figure 6:
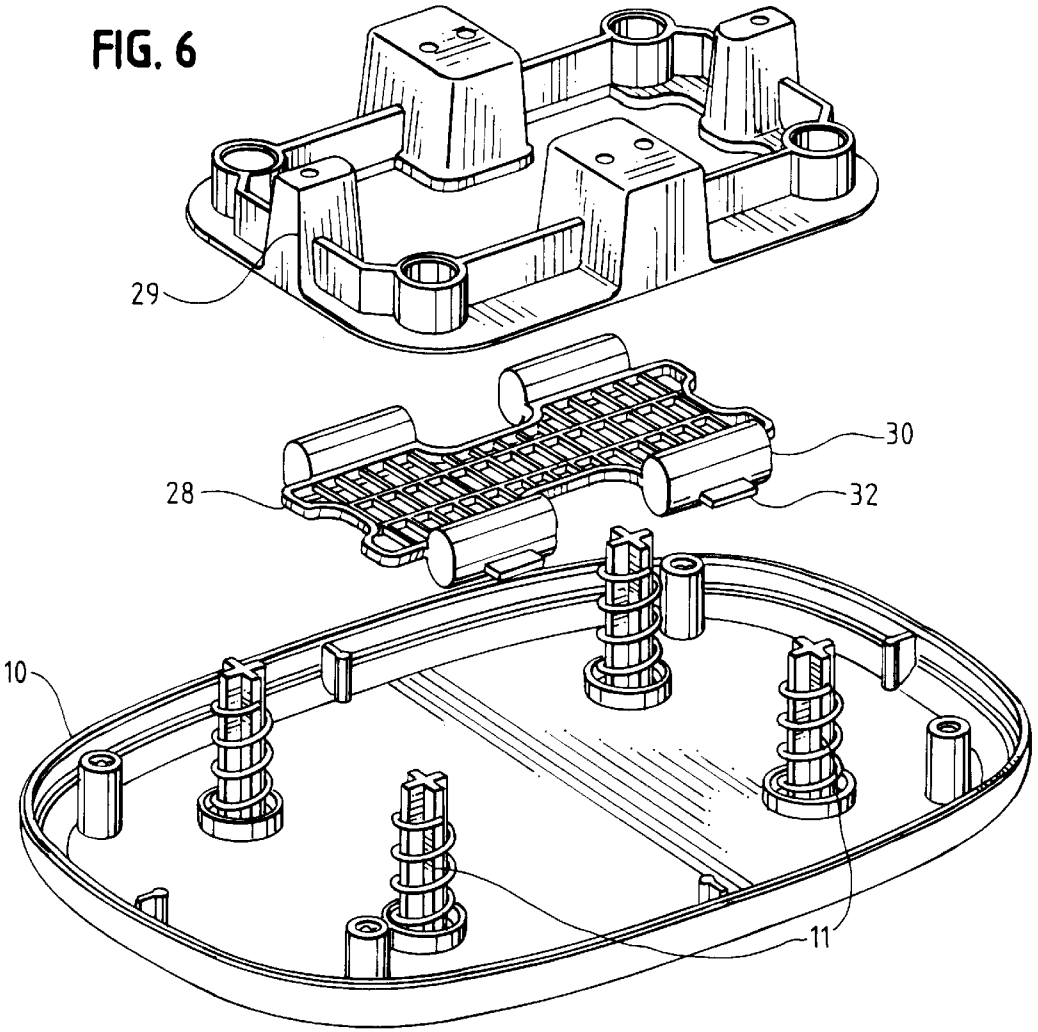
FIG. 6 is an exploded perspective view featuring only the lower housing, springs, and the carrier separated into two components (grating and support structure)
Figures 7, 8:
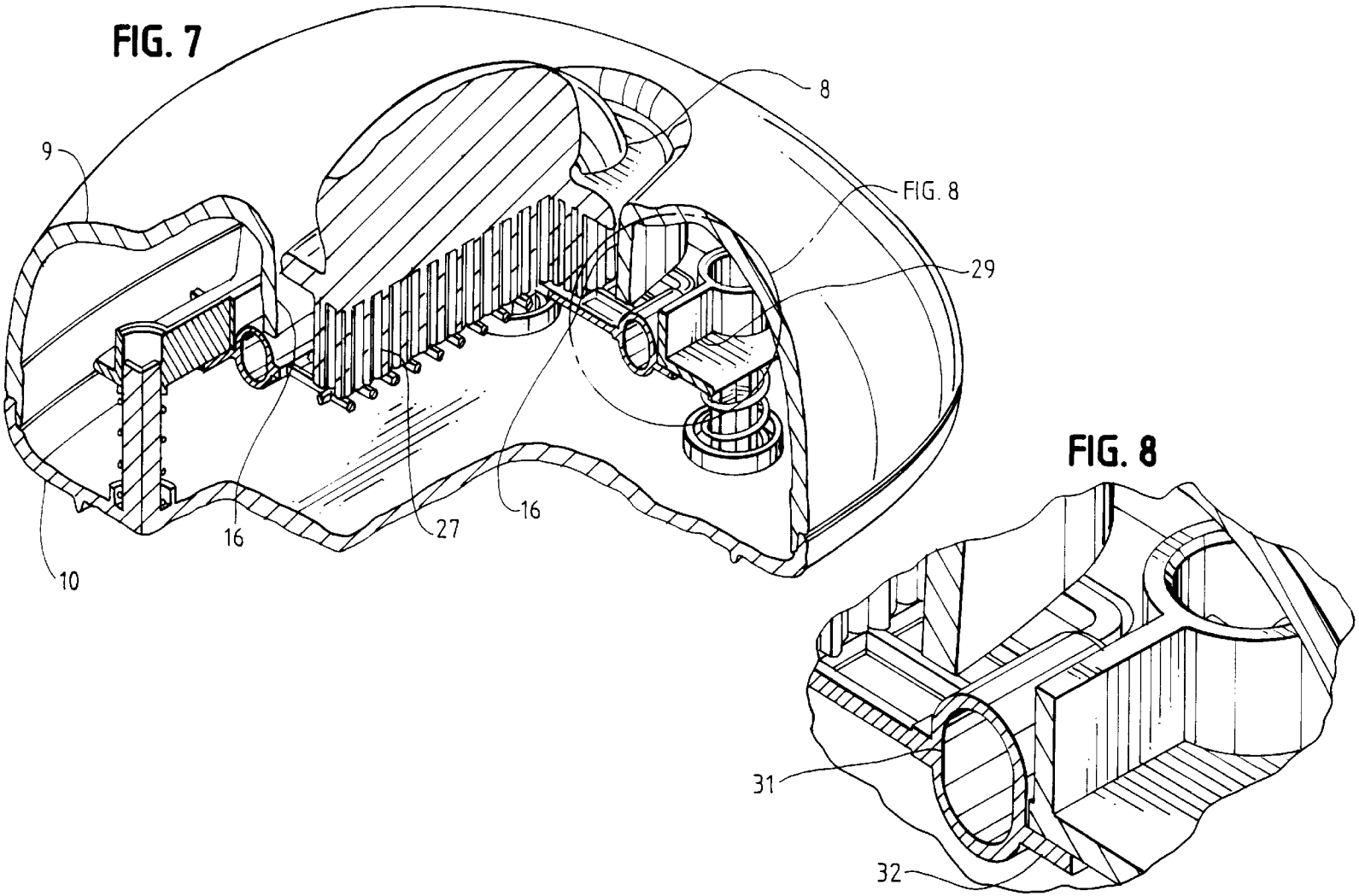
FIG. 7 is a perspective cross-sectional view illustrating an additional embodiment which breaks the carrier into two separate components.
FIG. 8 is a detailed view of FIG. 7, taken interior to circle DETAIL A.

Referring to FIGS. 6–8, in a second embodiment, the carrier 12 may be separated into two parts comprised of the grating 28 and the support structure 29. The grating 28 portion may have features that assist its floatation. These features could be similar to buoys 30. The buoys 30 would have a hollow construction 31. The gratings 28 floatation would be based on Archimedes Principle. The support structure 29 would operate in the same fashion as the one-piece carrier 12. In this alternative component form, features can be added to either the grating 28 or the support structure 29 to keep the hand/nail scrub brush bristles 27 from contacting the grating 28. One example an appropriate feature could be similar to the flange 32 extending from the buoys 30. The support structure 29 would contact the flanges 32 before the hand/nail scrub brush bristles 27 could ever contact the grating 28.

What is claimed is:

1. An apparatus for dispensing a liquid onto a cleaning implement which comprises:

a container defining a space for holding liquid, said container having an opening at the top for locating said cleaning implement;

a carrier means for holding the cleaning implement; and a spring means for mounting said carrier means to said container for movement from a first position, wherein said carrier means is held in suspension above said space for holding liquid, to a second position wherein said carrier means is moved into said space for holding liquid for engaging with a liquid located therein.

2. The apparatus of claim 1, wherein said container comprises an upper housing attached to a lower housing.

3. The apparatus of claim 2, further comprising:

a pump assembly mounted to said upper housing to provide a user with a second means with which to dispense liquid from said container.

4. The apparatus of claim 1, wherein said opening has the shape of said cleaning implement.

5. The apparatus of claim 1, wherein said carrier means has a liquid permeable surface.

6. A liquid soap dispenser and scrub-brush combination, comprising a substantially hollow housing defining a liquid soap reservoir, spring mounted support means normally held in suspension above liquid soap contained within said reservoir, a scrub brush resting upon said support means, such that bristles of the brush extend downwardly in the air above the liquid within the reservoir, said brush having a handle extending upwardly through an aperture in the upper portion of the housing to enable manual engagement by an operator, whereby downward force by the operator on the brush handle will depress the brush and the support means down to the level of liquid soap contained in the dispenser so that the bristles will engage said liquid soap, whereby upon release of manual pressure on the brush handle the spring mounted support means will rise away from the liquid soap to a position enabling removal and use by said operator.

7. An apparatus for dispensing a liquid onto a cleaning implement comprising:

a container defining a space for holding liquid, said container having an opening at the top for locating said cleaning implement;

a carrier means having a grating for allowing the flow of liquid through said carrier means, a floatation device coupled to the bottom of said grating to engage a liquid and cause said grating to float in suspension above said liquid, and a support means for holding said cleaning implement, said support means having an opening for locating said grating, wherein the bottom of said support means is engaged with the top of an outer edge of said grating; and a means for mounting said support means to said container for movement from a first position, wherein said grating floats in suspension above said space for holding liquid and a second position, wherein said grating is engaged with the liquid which is located in said space for holding liquid.

* * * * *